US009868151B2

(12) United States Patent
Kyeong et al.

(10) Patent No.: US 9,868,151 B2
(45) Date of Patent: Jan. 16, 2018

(54) METHOD FOR PRODUCING ALLUMINUM ALLOY

(71) Applicant: HYUNDAI MOBIS CO., LTD., Seoul (KR)

(72) Inventors: Joon Seok Kyeong, Seoul (KR); Woo Sik Lee, Yongin-si (KR); Yong Chun, Suwon-si (KR)

(73) Assignee: HYUNDAI MOBIS CO., LTD., Seoul (KR)

( * ) Notice: Subject to any disclaimer, the term of this patent is extended or adjusted under 35 U.S.C. 154(b) by 335 days.

(21) Appl. No.: 14/823,247

(22) Filed: Aug. 11, 2015

(65) Prior Publication Data

US 2016/0052052 A1 Feb. 25, 2016

(30) Foreign Application Priority Data

Aug. 20, 2014 (KR) ..... 10-2014-0108389

(51) Int. Cl.

| | |
|---|---|
| ***B22D 21/00*** | (2006.01) |
| ***C22C 1/02*** | (2006.01) |
| ***C22C 1/10*** | (2006.01) |
| ***C22C 21/00*** | (2006.01) |
| ***C22C 21/02*** | (2006.01) |
| ***C22C 21/06*** | (2006.01) |
| ***C22C 21/08*** | (2006.01) |
| ***C22C 21/10*** | (2006.01) |
| ***C22C 21/12*** | (2006.01) |
| ***C22C 21/14*** | (2006.01) |
| ***C22C 21/16*** | (2006.01) |
| ***C22C 21/18*** | (2006.01) |

(52) U.S. Cl.

CPC ..... *B22D 21/007* (2013.01); *C22C 1/026* (2013.01); *C22C 1/1036* (2013.01); *C22C 21/00* (2013.01); *C22C 21/02* (2013.01); *C22C 21/06* (2013.01); *C22C 21/08* (2013.01); *C22C 21/10* (2013.01); *C22C 21/12* (2013.01); *C22C 21/14* (2013.01); *C22C 21/16* (2013.01); *C22C 21/18* (2013.01)

(58) Field of Classification Search

CPC ..... B22D 21/007

See application file for complete search history.

(56) References Cited

FOREIGN PATENT DOCUMENTS

| | | |
|---|---|---|
| CN | 1275527 A | 12/2000 |
| CN | 103831422 A | 6/2014 |

OTHER PUBLICATIONS

Office Action dated Nov. 30, 2016 of corresponding Chinese Patent Application No. 201510502144.1—6 pages.

*Primary Examiner* — Kevin P Kerns
*Assistant Examiner* — Steven Ha
(74) *Attorney, Agent, or Firm* — Knobbe Martens Olson & Bear LLP

(57) ABSTRACT

A method for producing an aluminum alloy, comprises: separately preparing an aluminum or aluminum alloy matrix and an aluminum nitride-aluminum composite; melting the matrix, and adding the aluminum nitride-aluminum composite to the molten matrix to prepare a melt; and casting the melt.

6 Claims, 4 Drawing Sheets

METHOD FOR PRODUCING ALLUMINUM ALLOY

CROSS-REFERENCES TO RELATED APPLICATIONS

This application claims the benefit of Korean Patent Application No. 10-2014-0108389, filed on Aug. 20, 2014 in the Korean Intellectual Property Office, the entire disclosures of which are incorporated herein by reference.

BACKGROUND

Embodiments of the present invention relate to a method for producing an aluminum alloy having high design freedom and thermal conductivity.

Currently, the use of electronic control systems in automobiles is increasing. Thus, it is a major issue to efficiently dissipate heat generated from electronic devices integrated in a limited space during the operation of the electronic control system. Thus, there is an increased demand for alloy materials having high heat dissipation property, which can be applied to many electronic devices. In addition, in recent years, there has been a steady demand for automotive structural materials having lightweight and high functionality. Based on this, a demand for alloy materials having high heat dissipation property and high design freedom also has increased.

As alloy material candidates capable of having lightweight, high heat dissipation property and high design freedom as described above, aluminum alloys have been actively studied. Examples of aluminum alloys for heat dissipation include A6063 that is an extrusion material, and ADC 12 that is a die-casting material. A6063 has a relatively high thermal conductivity of about 200 W/(m·K), but has the disadvantage of a relatively low design freedom in terms of extrusion processes. ADC12 has a relatively high design freedom, because it is subjected to a casting process, but has the disadvantage of low thermal conductivity (about 90 W/(m·K)).

SUMMARY

Embodiments of the present invention provide a method for producing an aluminum alloy having a high design freedom and high thermal conductivity.

In accordance with one aspect of the present invention, there is provided a method for producing an aluminum alloy. The method for producing the aluminum alloy comprises the steps of: separately preparing an aluminum or aluminum alloy matrix and an aluminum nitride-aluminum composite; melting the matrix, and adding the aluminum nitride-aluminum composite to the molten matrix to prepare a melt; and casting the melt.

In an embodiment, the step of preparing the aluminum nitride-aluminum composite may comprise the steps of: providing aluminum to a furnace; supplying nitrogen gas to the inside of the furnace; and melting the aluminum in a nitrogen atmosphere.

In another embodiment, the furnace may be an arc furnace, and the step of melting the aluminum in the nitrogen atmosphere may comprise applying a voltage to the arc furnace to melt the aluminum, and nitrifying the molten aluminum.

In still another embodiment, the aluminum nitride-aluminum composite may be in the form of a porous solid.

In yet another embodiment, the step of preparing the melt may comprise: forming a first melt of the aluminum or aluminum alloy; and adding the aluminum nitride-aluminum composite to the first melt in an amount of 0.5-0.8 parts by weight based on 100 parts by weight of the aluminum or aluminum alloy.

DESCRIPTION OF EMBODIMENTS

Figure 1:
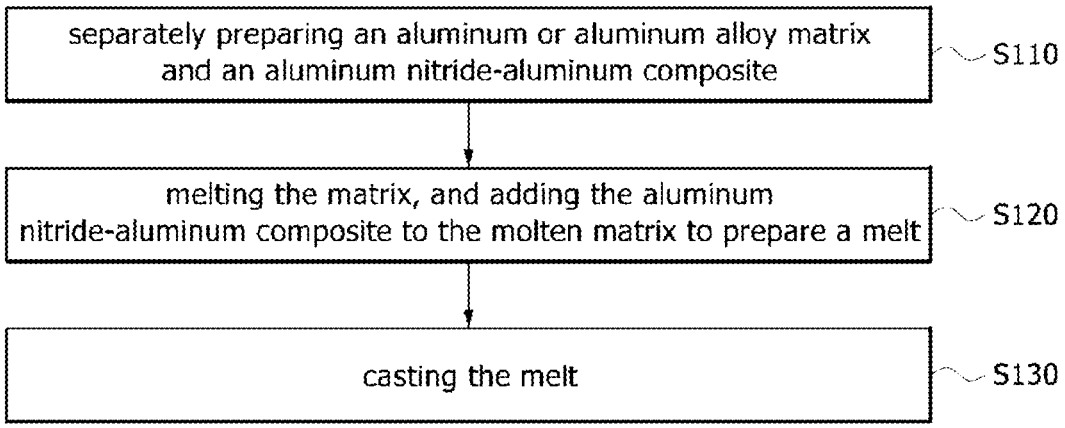
FIG. 1 is a flow chart schematically showing a method for producing an aluminum alloy according to an embodiment of the present invention.

Hereinafter, embodiments of the present invention will be described with reference to accompanying drawings. However, the embodiments are for illustrative purposes only and are not intended to limit the scope of the invention.

It will be understood that when any element is described as being "on", "above", "below" or on the "side" of another element in the embodiments of the present disclosure, this description means the relative positional relationship between the elements and does not define a case where the elements are in a direct contact with each other or where other elements are interposed between the two elements. In addition, it is to be understood that, when an element is referred to as being "connected" or "coupled" to another element, it can be connected or coupled directly to the other element or intervening elements may be present. Throughout the disclosure, like reference numerals refer to like parts throughout the various figures and embodiments of the present invention.

FIG. 1 is a flow chart schematically showing a method for producing an aluminum alloy according to an embodiment of the present invention. Referring to FIG. 1, in step S110, an aluminum or aluminum alloy matrix and an aluminum nitride-aluminum composite are separately prepared.

The aluminum in the matrix may be pure aluminum. In addition, the aluminum alloy in the matrix may be, for example, any one of 1000 series, 2000 series, 3000 series, 4000 series, 5000 series, 6000 series, 7000 series or 8000 series wrought aluminum alloys or 100 series, 200 series, 300 series, 400 series, 500 series and 700 series casting aluminum alloys. The above-described aluminum alloys are in accordance with the standards of the Aluminum Association of America, which are currently adopted in almost all countries. For example, Table 1 below shows the major alloying elements of alloy series according to the standards.

TABLE 1

| Alloy series | Major alloying elements |
|---|---|
| 1000 series aluminum alloy | Pure aluminum |
| 2000 series aluminum alloy | Al—Cu—(Mg) - based aluminum alloy |
| 3000 series aluminum alloy | Al—Mn - based aluminum alloy |

TABLE 1-continued

| Alloy series | Major alloying elements |
|---|---|
| 4000 series aluminum alloy | Al—Si - based aluminum alloy |
| 5000 series aluminum alloy | Al—Mg - based aluminum alloy |
| 6000 series aluminum alloy | Al—Mg—Si - based aluminum alloy |
| 7000 series aluminum alloy | Al—Zn—Mg—(Cu) - based aluminum alloy |
| 8000 series aluminum alloy | Others |

In Table 1, in the first numeral position, an alloy series indicating a major alloying element is expressed. In the second numeral position, a base alloy is expressed as 0, a modified alloy is expressed as an integer ranging from 1 to 9, and a new developed alloy is expressed as N. For example, 20xx is a base alloy of Al-Cu series aluminum, and 21xx-29xx are alloys obtained by modifying the Al-Cu series base alloy, and 2Nxx are new developed alloys other than the standards of the Aluminum Association of America. In addition, the third and fourth numerals indicate the purity of aluminum in the case of pure aluminum or indicate the names of Alcoa alloys used in the past. For example, in the case of pure aluminum, 1080 indicates that the purity of aluminum is more than 99.80% Al.

Table 2 below shows the detailed composition of the major alloying elements of alloy series according to the standards.

TABLE 2

| Grade | Additive metal (element symbol) [wt %] | | | | | | |
|---|---|---|---|---|---|---|---|
| number | Si | Cu | Mn | Mg | Cr | Zn | Others |
| 2014 | 0.8 | 4.4 | 0.8 | 0.5 | | | |
| 2091 | | 2.2 | | 1.5 | | | Li 2.2, Zr 0.12 |
| 2219 | | 6.3 | 0.3 | | | | V 0.1, Zr 0.18, Ti 0.06 |
| 3105 | | | 0.6 | 0.5 | | | |
| 5182 | | | 0.35 | 4.5 | | | |
| 6009 | 0.8 | 0.33 | 0.33 | 0.5 | | | |
| 7005 | | | 0.45 | 1.4 | 0.13 | 4.5 | Zr 0.14 |
| 7075 | | 1.6 | | 2.5 | 0.25 | 5.6 | |
| 8090 | | 1.3 | | 0.9 | | | Li 2.4, Zr 0.12 |

The contents of elements that are added to aluminum alloys of various series as described above, which are applied to embodiments of the present invention, may be as follows: silicon (Si): 1.5 wt % or less, iron (Fe): 1.5 wt % or less, copper (Cu): 5 wt % or less, manganese (Mn): 1 wt % or less, magnesium (Mg): 2 wt % or less, chromium (Cr): 1 wt % or less, nickel (Ni): 1 wt % or less, zinc (Zn): 5 wt % or less, lead (Pb): 0.5 wt % or less, in (Sn): 0.5 wt % or less, titanium (Ti): 0.5 wt % or less, antimony (Sb): 0.1 wt % or less, and beryllium (Be) 0.1 wt %.

In a more specific embodiment, the aluminum alloy may comprise 9.6-12 wt % of silicon (Si), more than 0 wt % but not more than 1.3 wt % of iron (Fe), 1.5-3.5 wt % of copper (Cu), more than 0 wt % but not more than 0.3 wt % of manganese (Mn), more than 0 wt % but not more than 0.5 wt % of nickel (Ni), more than 0 wt % but not more than 1.0 wt % of zinc (Zn), more than 0 wt % but not more than 0.3 wt % of tin (Sn), and the remainder aluminum (Al). In another embodiment, the aluminum alloy may comprise 6.5-7.5 wt % of silicon (Si), 0.2 wt % of iron (Fe), 0.2 wt % of copper (Cu), 0.1 wt % of manganese (Mn), 0.1 wt % of zinc (Zn), 0.20 wt % of titanium (Ti) 0.20 wt %, and the remainder aluminum (Al).

Meanwhile, in step S110, an aluminum nitride-aluminum composite is separately prepared. In an embodiment, the aluminum nitride-aluminum composite may be in the form of a porous solid. The aluminum nitride-aluminum composite may comprise aluminum nitride precipitated in the aluminum matrix. A specific method for preparing the aluminum nitride-aluminum composite will be described below with reference to FIG. 2.

Referring to step S120 in FIG. 1, the matrix is melted, and the aluminum nitride-aluminum composite is added to the molten matrix to prepare a melt. In an embodiment, the aluminum or the aluminum alloy is melted to form a first melt. Then, the aluminum nitride-aluminum composite is added to the first melt in an amount of 0.5-8 parts by weight based on 100 parts by weight of the aluminum or aluminum alloy. Then, the first melt is stirred and maintained. In this way, a melt comprising the aluminum nitride-aluminum composite added to the matrix can be prepared.

In an embodiment, when the aluminum nitride-aluminum composite is in the form of a porous solid, there is an advantage in that the aluminum nitride-aluminum composite is easily dispersed uniformly in the first melt. However, if the aluminum nitride-aluminum composite is provided in the form of powder, the powder will be concentrated on the surface of the first melt due to its relatively low specific gravity, and thus can be difficult to disperse uniformly in the first melt.

Referring to step S130 in FIG. 1, the melt is cast in a mold and cooled. Then, the solidified aluminum alloy is separated from the mold.

Without washing to be limited to a particular theory, it is believed that nitrogen atoms are separated from the aluminum nitride of the composite during step S120, and the nitrogen atoms can be rearranged as interstitial atoms in the aluminum base. Such interstitial nitrogen atoms can increase the thermal conductivity of the aluminum alloy.

Figure 2:
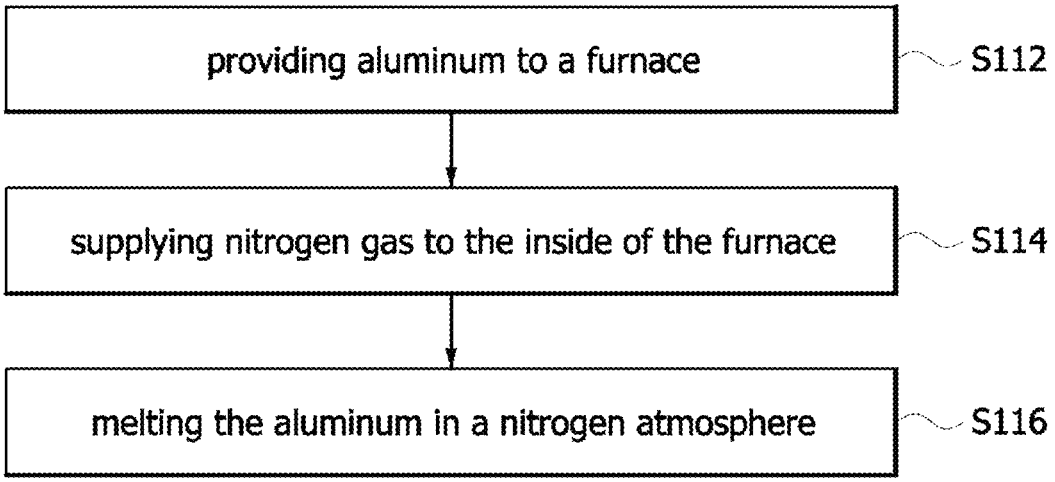
FIG. 2 is a flow chart schematically showing a method for preparing an aluminum nitride-aluminum composite according to an embodiment of the present invention.

FIG. 2 is a flow chart schematically showing a method for preparing an aluminum nitride-aluminum composite according to an embodiment of the present invention.

Referring to FIG. 2, in step S112, aluminum is supplied to a furnace. Herein, the aluminum may be pure aluminum or an aluminum alloy. The furnace may be any furnace that can be heated to about 2500° C. or higher, which is the melting point of aluminum. However, for the convenience of explanation, the use of an arc furnace will be described by way of example below. The arc furnace has an advantage in that it can be heated to high temperature within a short time by applying a high voltage thereto and can be maintained at the heated temperature.

In step S114, nitrogen gas is supplied to the inside of the furnace. If an arc furnace is used as the furnace, nitrogen gas may be supplied to the inside of the arc furnace after the inside of the arc furnace is depressurized to vacuum. For the generation of arc, inert gas such as argon gas may also be supplied to the inside of the arc furnace.

In step S116, the aluminum is melted in a nitrogen atmosphere. In this case, the nitrification reaction of the molten aluminum with nitrogen can occur. If the furnace used is an arc furnace, the arc melting time can be maintained at about 15-60 seconds.

When the above-described process is performed, the aluminum nitride composite can be prepared.

Figure 3:
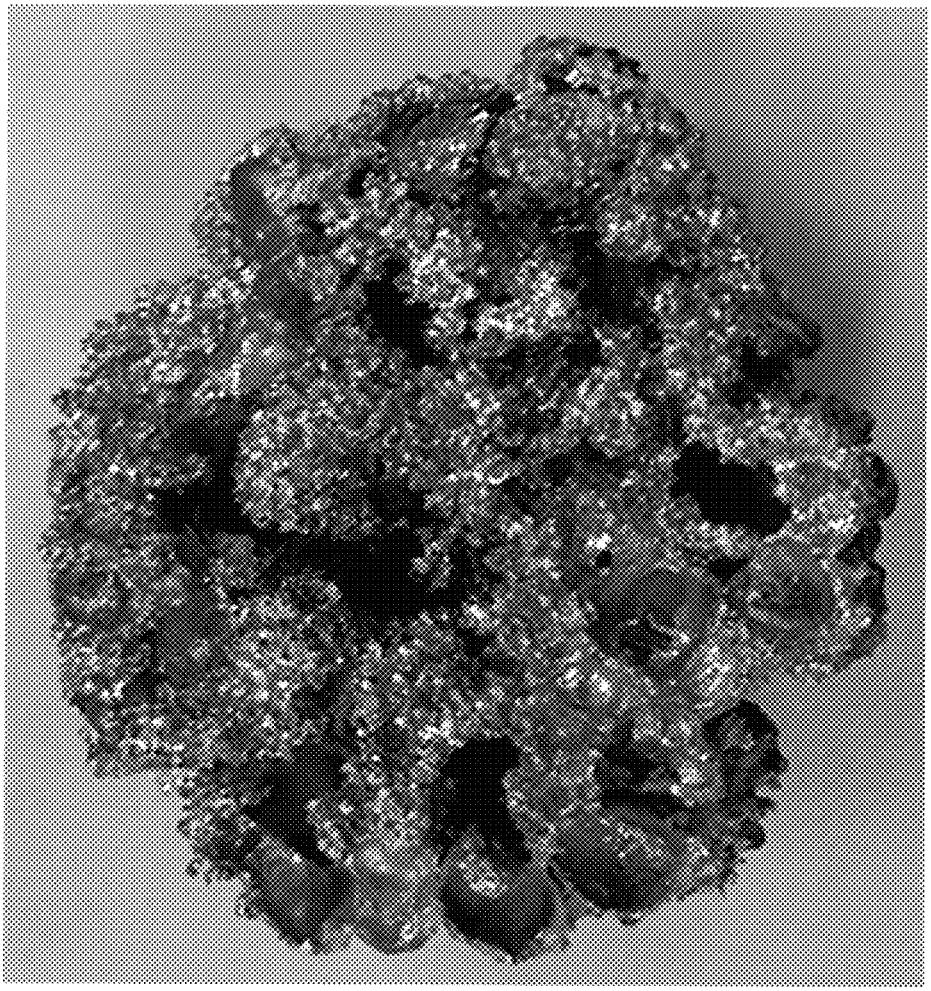
FIG. 3 is a photograph of an aluminum nitride-aluminum composite prepared by a preparation method according to an embodiment of the present invention.
Figure 4:
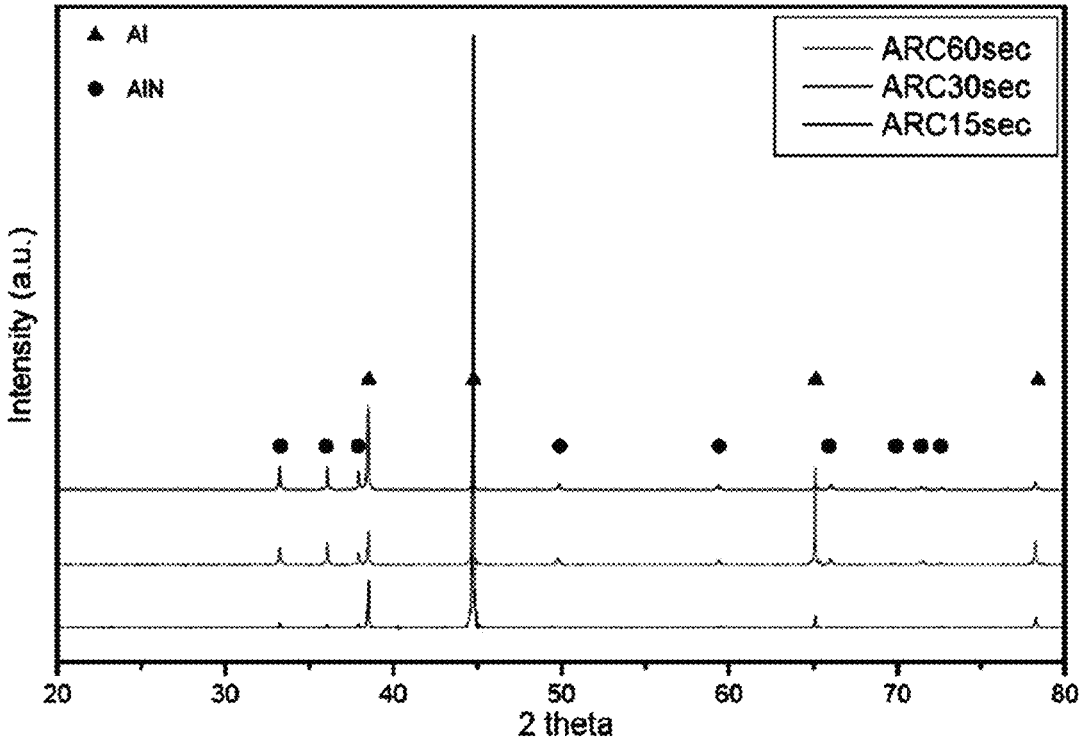
FIG. 4 is a graph showing the results of X-ray diffraction analysis of an aluminum nitride-aluminum composite prepared by a preparation method according to an embodiment of the present invention.

FIG. 3 is a photograph of an aluminum nitride-aluminum composite prepared by a preparation method according to an embodiment of the present invention. Specifically, the aluminum nitride-aluminum composite shown in FIG. 3 is the aluminum nitride-aluminum composite prepared in the arc furnace according to the flow chart of FIG. 2. FIG. 4 is a graph showing the results of X-ray diffraction analysis of an aluminum nitride-aluminum composite prepared by a preparation method according to an embodiment of the present invention.

As shown in FIG. 3, the aluminum nitride-aluminum composite may be a porous solid. It can be seen that the outer portion of the sample was swollen due to arc melting and pores were formed in the sample. It is believed that the internal pores were formed because the aluminum was instantaneously heated by arc to its melting point or higher. In addition, it is believed that vaporized aluminum reacts with the nitrogen atom of nitrogen gas to form aluminum nitride.

Referring to FIG. 4, the X-ray diffraction pattern at the time of arc melting in the arc furnace can be seen. Specifically, at arc melting times of 15 sec, 30 sec and 60 sec, only the peaks of aluminum (Al) and aluminum nitride (AlN) were observed, suggesting that an aluminum-aluminum nitride composite having aluminum nitride precipitated therein was prepared. Meanwhile, it can be seen that the peak of aluminum nitride increased as the arc melting time increased. In other words, it can be seen that the production of aluminum nitride increases as the arc melting time increases.

Hereinafter, the thermal conductivity characteristics of aluminum alloy samples prepared by examples of the present invention will be evaluated in detail.

Embodiment 1

A356 that is a conventional casting aluminum alloy was prepared. In addition, an aluminum nitride-aluminum composite produced as described above with respect to FIG. 2 was prepared.

The A356 aluminum alloy was used as Comparative Example 1. Meanwhile, each of 0.5 g, 1 g, 1.5 g and 2 g of the aluminum nitride-aluminum composite was added to 100 g of the A356 aluminum alloy to prepare melts, and the melts were cast, thereby preparing aluminum alloys of Example 1, Example 2, Example 3 and Example 4.

Table 3 below shows the results of measuring the thermal conductivities of the aluminum alloys of Comparative Example 1 and Examples 1 to 4 at 25° C. and 50° C.

TABLE 3

| | Comparative Example 1 | Example 1 | Example 2 | Example 3 | Example 4 |
|---|---|---|---|---|---|
| Thermal conductivity [W/(m · K) @ 25° C.] | 166 | 169 | 171 | 175 | 173 |
| Thermal conductivity [W/(m · K) @ 50° C.] | 169 | 171 | 170 | 176 | 175 |

As can be seen from the test results in Table 3 above, the aluminum alloys of Examples 1 to 4, prepared by adding the aluminum nitride-aluminum composite to the A356 aluminum alloy, showed higher thermal conductivities at 25° C. and 50° C. compared to the aluminum alloy of Comparative Example 1. Particularly, the aluminum alloy of Example 3 showed an increase in thermal conductivity at 25° C. of about 5.4%, and an increase in thermal conductivity at 50° C. of about 4.1%, compared to that of Comparative Example 1.

Embodiment 2

ADC12 that is a conventional casting aluminum alloy was prepared. In addition, an aluminum nitride-aluminum composite produced as described above with respect to FIG. 2 was prepared.

The ADC12 aluminum alloy was used as Comparative Example 2. Meanwhile, each of 1 g, 2 g and 8 g of the aluminum nitride-aluminum composite was added to 100 g of the ADC12 aluminum alloy to prepare melts, and the melts were cast, thereby preparing aluminum alloys of Example 5, Example 6 and Example 7.

Table 4 below shows the results of measuring the thermal conductivities of the aluminum alloys of Comparative Example 2 and Examples 5 to 7 at 25° C.

TABLE 4

| | Comparative Example 2 | Example 5 | Example 6 | Example 7 |
|---|---|---|---|---|
| Thermal conductivity [W/(m · K) @ 25° C.] | 92 | 115 | 130 | 147 |

As can be seen from the test results in Table 4 above, the aluminum alloys of Examples 5 to 7, prepared by adding the aluminum nitride-aluminum composite to the ADC12 aluminum alloy, showed higher thermal conductivities at 25° C. compared to the aluminum alloy of Comparative Example 2. Particularly, the aluminum alloy of Example 7 showed an increase in thermal conductivity at 25° C. of about 60.0%, compared to that of Comparative Example 2.

As described above, according to embodiments of the present invention, an aluminum alloy can be produced by adding an aluminum nitride-aluminum composite to an aluminum or aluminum alloy matrix having a predetermined composition and subjecting the composite/matrix mixture to a casting process. The aluminum nitride-aluminum composite can increase the thermal conductivity of the resulting cast aluminum alloy, and the casting process can guarantee a high design freedom.

The aluminum nitride-aluminum composite is not in the form of powder, but may be in the form of a porous solid. When the composite is in the form of a porous solid, there is an advantage in that the composite is easily dispersed uniformly in an aluminum alloy melt.

The embodiments of the present invention have been disclosed above for illustrative purposes. Those skilled in the art will appreciate that various modifications, additions and substitutions are possible, without departing from the scope and spirit of the invention as disclosed in the accompanying claims.

What is claimed is:

1. A method for producing an aluminum alloy, comprising the steps of:

separately preparing an aluminum or aluminum alloy matrix and an aluminum nitride-aluminum composite;

melting the matrix, and adding the aluminum nitride-aluminum composite to the molten matrix to prepare a melt; and casting the melt.

2. The method of claim 1, wherein the step of preparing the aluminum nitride-aluminum composite comprises the steps of:

providing aluminum to a furnace;

supplying nitrogen gas to an inside of the furnace; and melting the aluminum in a nitrogen atmosphere.

3. The method of claim 2, wherein the furnace is an arc furnace, and the step of melting the aluminum in the nitrogen atmosphere comprise a step of applying a voltage to the arc furnace to melt the aluminum, and nitrifying the molten aluminum.

4. The method of claim 1, wherein the aluminum nitride-aluminum composite is added in the form of a porous solid, not in powder.

5. The method of claim 1, wherein the step of preparing the melt comprises:

forming a first melt of the aluminum or aluminum alloy; and adding the aluminum nitride-aluminum composite to the first melt in an amount of 0.5-0.8 parts by weight based on 100 parts by weight of the aluminum or aluminum alloy.

6. A method of producing a cast product comprising aluminum alloy, comprising:

providing a matrix comprising aluminum or aluminum alloy;

melting aluminum in a nitrogen atmosphere to provide an aluminum nitride-aluminum composite;

melting the matrix;

adding the aluminum nitride-aluminum composite to the molten matrix to prepare a melt, wherein the aluminum nitride-aluminum composite is added not in powder form; and casting the melt to provide a cast product comprising aluminum alloy.

* * * * *